8/13/85 OR 4,534,116

United States Patent [19]

Davis

[11] Patent Number: 4,534,116

[45] Date of Patent: Aug. 13, 1985

[54] ADAPTER FOR BORESIGHT TELESCOPE

[75] Inventor: James E. Davis, Lake Park, Fla.

[73] Assignee: Lenzar Optics Corporation, Riviera Beach, Fla.

[21] Appl. No.: 526,704

[22] Filed: Aug. 26, 1983

[51] Int. Cl.[3] ..... F41G 1/54

[52] U.S. Cl. ..... 33/234; 279/2 R

[58] Field of Search ..... 33/234; 279/2 R; 242/72, 72.1, 46.1

[56] References Cited

U.S. PATENT DOCUMENTS

| | | | |
|---|---|---|---|
| 1,994,177 | 3/1935 | Nolan . | |
| 2,353,272 | 7/1944 | Simmons et al. . | |
| 2,367,288 | 1/1945 | Klopp et al. | 33/234 |
| 2,476,981 | 7/1949 | Horton . | |
| 2,654,413 | 10/1953 | Weidel | 279/2 R X |
| 2,696,052 | 12/1954 | Czarnikow | 33/234 |
| 2,852,262 | 9/1958 | Parker et al. | 279/2 R |
| 3,112,567 | 12/1963 | Flanagan | 33/234 |
| 3,228,108 | 1/1966 | Chaperon . | |
| 4,090,305 | 5/1978 | Cassidy | 33/234 |

*Primary Examiner*—William D. Martin, Jr.

*Attorney, Agent, or Firm*—Costas, Montgomery & Dorman

[57] ABSTRACT

A boresighting instrument which comprises a muzzle end adapter having a frustro conical outer periphery adapted to be inserted into the muzzle end of a barrel threadably receiving a central shaft, a sleeve is coaxially coupled to the muzzle end adapter and extends to a radially extending member, the central shaft extends to the radially extending plate and has coupled thereto an expandable member comprising a plurality of rigid finger members equiangularly disposed about the axis of the central shaft and secured together by an elastomeric material, the fingers of the expandable member have frustro conical inner edges, an expander member is secured to the central shaft and has a frustro conical surface adapted to engage the inner edges of the fingers whereby when the central shaft is rotated in one direction on the threaded connection with the muzzle end adapter, the expander member forces the fingers radially outwardly into engagement with the inner periphery of the barrel.

4 Claims, 2 Drawing Figures

ADAPTER FOR BORESIGHT TELESCOPE

FIELD OF THE INVENTION

This invention relates to boresighting apparatus.

BACKGROUND OF THE INVENTION

In the calibration of sighting devices for guns it is necessary that the axis of a barrel of the gun be parallel to the axis of the optical sighting system or, in some cases, that the axis of the optical sighting system cross the axis of the barrel at a given distance. In almost all large caliber guns, such as those mounted to a tank, the optical sighting system is displaced from the axis of the barrel of the gun. A predetermined relationship of the barrel axis and optical axis must be established and from time to time recalibration must be made. To initially calibrate, or to recalibrate, the relationship of the two aforementioned axes must be determined and a sight made preferably to a calibration target at a given distance. In order for such calibration or recalibration to be accurate and effective, a line of sight along the axis of the barrel must be established. Then the axis of the optical system may be adjusted in accordance with the desired calibration.

Boresighting apparatus for large caliber guns are disclosed in U.S. Pat. No. 1,994,177. Sight adjusters for smaller caliber guns are disclosed in U.S. Pat. Nos. 2,353,272; 2,476,981; 3,228,108; and 4,090,305. The last mentioned patent discloses a rifle sight adjuster where a conical muzzle end adapter engages a end of the muzzle and a member extends therefrom into a barrel and carries a compressable washer type member, which when compressed in the axial direction, will expand radially and theoretically engage the interior periphery of the barrel and center the device therein. A device such as this theoretically could provide centering of the adapter device within the barrel of a gun. However, the accuracy of this device is dependent on the distance the expandable washer is extended into the barrel and the accuracy is subject to wear and abrasion of the expandable washer. Also, the device of this patent requires very accurate positioning and spacing of the expandable washer member on the rod extending within the barrel.

The present invention provides a new and improved boresight adapter in which an accurate centering device may be inserted into the muzzle end of a barrel only two to three diameters of the bore of the barrel and will accurately determine the center of the barrel with very high repeatability.

SUMMARY OF THE INVENTION

Briefly stated, the invention in one form thereof, comprises an assembly which includes a muzzle end adapter having a conical exterior, which is insertable a sufficient distance into the muzzle end of the barrel to compensate for any flare thereon. The muzzle end adapter has a central shaft extending therethrough, which is threaded to a collar on the muzzle end adapter. The central shaft has affixed thereto an axially aligned expander member having a conical outer periphery. A sleeve member is affixed to the muzzle end adapter and extends inwardly of the barrel to a radially extending reaction plate. The sleeve and the central shaft are coaxial. A centering device which comprises a plurality of equiangularly spaced fingers bonded and/or otherwise connected with an elastomeric material, is provided The fingers have outer edges, which are essentially parallel to the axis of the central shaft, and have inner edges which are defined on an incline, mating with the outer periphery of the expandable member. When the central shaft is rotated in a direction so that its threaded connection to the muzzle end adapter collar causes it to move outwardly of the barrel, the expander member engages the inclined edges of the fingers and forces all of the fingers radially outwardly with equal movement. The outer edges of the fingers will then engage the inner periphery of the barrel and align the axis of the central shaft with the axis of the barrel. A boresighting telescope is then positioned coaxial with the axis of the central shaft and a sight may be made along the axis of the shaft to a calibration target.

An object of this invention is to provide a new and improved boresighting instrument.

Another object of this invention is to provide a new and improved boresighting instrument which is highly accurate with very high repeatability.

The features of the invention, which are believed to be novel, are particularly pointed out and distinctly claimed in the concluding portion of this specification. The invention, however, both as to its organization and operation, together with further objects and advantages thereof, may best be appreciated by reference to the following detailed description taken in conjunction with the drawings.

DETAILED DESCRIPTION OF THE INVENTION

Figure 1:
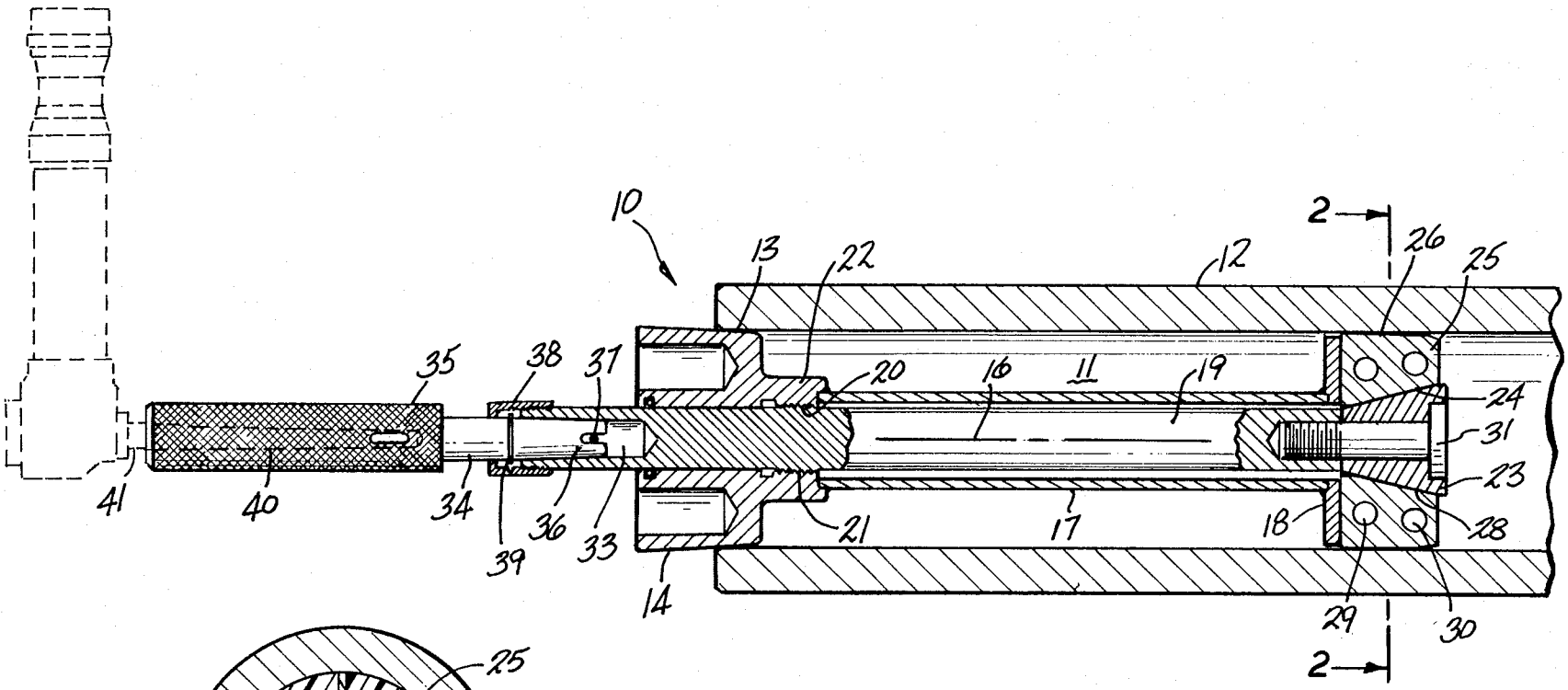
FIG. 1 is a side elevation, partly in section, of a device embodying the invention shown in the bore of a gun barrel.
Figure 2:
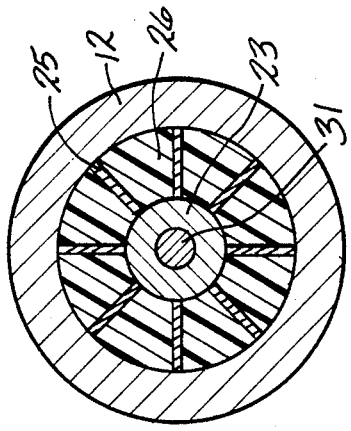
FIG. 2 is a view seen in the plan of lines 2—2 of FIG. 1.

A device 10 embodying the invention is shown inserted into the bore 11 of the gun barrel 12. Normally, such barrels after firing will develop a slight flare indicated in the area 13 at the muzzle end. The device 10 comprises a muzzle end adapter 14 having an outer periphery 15 which is tapered slightly to provide a frustro-conical periphery about a central axis 16. Rigidly attached to muzzle end adapter 14, and coaxial therewith, is a sleeve 17 which extends toward the breach end of the gun a distance of two to three diameters of bore 11. Rigidly attached to sleeve 17 and perpendicular to the axes 16 is a reaction plate 18. Axially extending through muzzle end adapter 14 is a central shaft 19. Central shaft 19 has threads 20 which mate with internal threads 21 in a collar 22 extending from muzzle end adapter 14. Coaxially affixed to control shaft 17 is an expander member 23 having a frustro-conical surface 24. Disposed about surface 24 of expander member 23 is a centering device which comprises a plurality of equiangularly spaced fingers 25 (eight as shown) which are embedded in and connected by an elastomeric material 26. The fingers 25 have outer edges 27 which are parallel to axes 16 and also to the internal periphery of the bore 11. The inner edges 28 of fingers 25 are inclined at an angle which mates the edges 28 with the surface 24 of expander 23. The fingers 25 have a slight taper on the ends thereof to facilitate entry into a barrel.

The fingers are formed with apertures 29 and 30 therein. The centering device is formed by placing the fingers in a mold and casting the elastomeric material therein so that all fingers are interlocked with the elastomeric material passing through the apertures 29 and 30 of each finger and further bonding to the side walls of fingers 25.

Expander 23 is coaxially affixed to control shaft 17 as by means of a bolt 31.

When control shaft 17 is rotated in a direction so that the engagement of threads 20 and 21 move central shaft 19 to the left, as shown in FIG. 1, expander member 23, acting on the edges 28 of fingers 25, force the fingers 25 outwardly against the inner periphery of the bore 11 of barrel 12.

The elastomeric material maintains the fingers equiangularly spaced about the axis of the barrel. In this manner, the axis 16 is coincident with the axis of the bore. Control shaft 17 has a tapered bore 33 defined in the muzzle end thereof which receives an extension 34 of an adjusting member 35. A slot 36 is defined in the end of rod 34 and receives therethrough a pin 37 which also extends through shaft 19, thus coupling rod 34 and adjusting member 35 to shaft 19. Bore 33, extension rod 34, and adjusting member 35 are so formed as to be on an axis which is coincident with axis 16.

A coupling member 38 is threadably attached to shaft 19 at the muzzle end thereof and includes a circumferential slot which receives a lock washer 39 set in a circumferential groove on rod 34.

Adjusting member 35 has an axially tapered bore 40 which receives a matingly tapered adapter 41 of a boresight telescope. The optical axis of the telescope is folded and is coincident with the axis 16. A preferred form of a boresight telescope is disclosed in U.S. Pat. No. 2,696,052.

With the construction shown, the center of the bore of a barrel may be quickly located and aligned with the axis of the boresight telescope. Then the barrel of the gun is moved to sight the barrel on a target which may be positioned at a known distance. Thereafter, the optical sighting for the gun may be adjusted to be either parallel to the axis of the barrel or to intersect the axis of the barrel at a given distance.

After adjustment has been accomplished, the boresight telescope is removed. The adjusting member is rotated to permit the elastomeric material, which is in tension, to relax and move the fingers 25 radially inwardly, then the complete adapter may be removed from the bore of the gun. The elastomeric material is preferably rubber.

While a preferred embodiment of the invention has been set forth for purposes of disclosure, modifications to the disclosed embodiment, as well as other embodiments thereof, may occur to those skilled in the art. Accordingly, the appending claims are intended to cover all embodiments of the invention as well as other embodiments thereof which do not depart from the spirit and scope of the invention.

What is claimed is:

1. A bore sighting instrument comprising a muzzle end adapter having a frustro-conical outer periphery adapted to be inserted into the muzzle end of a barrel, said adapter having a central bore receiving a central shaft therethrough, said central shaft being threadably coupled to said adapter, a sleeve affixed to said adapter and coaxially disposed about said central shaft and adapted to be inserted into a barrel, a radially expandable member, said expandable member comprising a plurality of rigid finger members equiangularly disposed about the axis of said central shaft and secured together by an elastomeric material, said fingers having parallel outer edges adapted to engage the inner periphery of a barrel, said fingers having inner edges equally inclined to the axis of said central shaft, an expander member having a frustro-conical periphery engaging the inner edges of said fingers, said expander member being coaxially attached to said central shaft, a radially extending plate member affixed to the end of said sleeve and providing a surface in engagement with vertical edges of said fingers, whereby when said central shaft is rotated in one direction on said threaded connection with said muzzle end adapter, said expander member forces said fingers radially outwardly into engagement with the inner periphery of said barrel.

2. The instrument of claim 1 further including an adjusting member, means coaxially coupling said adjusting member to said central shaft whereby rotation of said adjusting member rotates said central shaft.

3. The instrument of claim 2 wherein said adjusting member has an axially tapered bore which receives an adapter of a boresight telescope.

4. The instrument of claim 1 where said fingers have apertures therethrough intermediate said edges thereof which receive said elastomeric material.

* * * * *